US009707678B2

(12) United States Patent
Lampe et al.

(10) Patent No.: US 9,707,678 B2
(45) **Date of Patent: *Jul. 18, 2017**

(54) COMBINED PORTABLE STEP STOOL AND WORKPIECE SUPPORT DEVICE

(71) Applicant: Lampe Holding B.V., Luchthaven Schiphol (NL)

(72) Inventors: Caspar Bernard Lampe, Luchthaven Schiphol (NL); Maarten Olden, Amsterdam (NL)

(73) Assignee: Lampe Holding B.V., Luchthaven Schiphol (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/492,817

(22) Filed: Sep. 22, 2014

(65) Prior Publication Data

US 2015/0008071 A1 Jan. 8, 2015

Related U.S. Application Data

(63) Continuation of application No. 13/504,631, filed as application No. PCT/NL2010/050740 on Nov. 5, 2010, now Pat. No. 8,869,937.

(30) Foreign Application Priority Data

Nov. 6, 2009 (NL) ..... 2003764

(51) Int. Cl.
*B25H 1/06* (2006.01)
*E06C 7/50* (2006.01)

(52) U.S. Cl.
CPC *B25H 1/06* (2013.01); *E06C 7/50* (2013.01)

(58) Field of Classification Search
CPC ..... B25H 1/06
See application file for complete search history.

(56) References Cited

U.S. PATENT DOCUMENTS 782,393 A * 2/1905 Hazelton ..... 182/33
2,652,967 A * 9/1953 Hansen ..... E06C 1/393 182/123

(Continued)

FOREIGN PATENT DOCUMENTS

DE 1779295 A1 * 11/1971 ..... E06C 1/18
EP 1182322 A1 2/2002

(Continued)

OTHER PUBLICATIONS

International Preliminary Report on Patentability for PCT/NL2010/050740 dated May 8, 2012.

(Continued)

*Primary Examiner* — Alvin Chin-Shue
(74) *Attorney, Agent, or Firm* — Hoffmann & Baron, LLP

(57) ABSTRACT

A combined step stool and workpiece support device has a folding frame with a rigid front leg structure including front legs and a first support bar interconnecting the front legs at an upper end thereof. The frame also includes a rear leg structure including rear legs, each being pivoted to a front leg via a first hinge for movement of the rear leg structure between a use position and a storage position. Portions of the front legs above the first hinges and the first support bar form a first workpiece support bracket. The device includes a pivotable rigid second workpiece support bracket with a pair of arms, each having a lower end pivotally connected via a second hinge to the frame. The second support bracket is pivotal between a use position and a collapsed position.

8 Claims, 7 Drawing Sheets

(56) References Cited

U.S. PATENT DOCUMENTS

| | | | | |
|---|---|---|---|---|
| 2,905,263 | A * | 9/1959 | Andersson | 182/154 |
| 3,127,953 | A | 4/1964 | Shore | |
| 4,276,955 | A | 7/1981 | Hickman | |
| 4,566,150 | A | 1/1986 | Boothe | |
| 5,265,697 | A | 11/1993 | Quick | |
| 5,526,897 | A | 6/1996 | Schiller | |
| 6,012,548 | A | 1/2000 | Kim | |
| 6,164,413 | A * | 12/2000 | Sagol | 182/153 |
| 6,286,824 | B1 | 9/2001 | Sagol | |
| 6,298,946 | B1 | 10/2001 | Yemini | |
| 6,347,687 | B1 * | 2/2002 | Alim | 182/161 |
| 7,100,739 | B2 * | 9/2006 | Parker | A47C 12/00 182/163 |
| 7,128,187 | B2 | 10/2006 | Simpson | |
| 7,158,187 | B2 | 1/2007 | Suzuki | |
| 7,287,730 | B1 * | 10/2007 | Chen | B25H 1/04 108/118 |
| 7,931,123 | B2 * | 4/2011 | Moldthan et al. | 182/129 |
| 7,984,790 | B2 * | 7/2011 | Meyers et al. | 182/129 |
| 2002/0017430 | A1 | 2/2002 | Rosko | |
| 2002/0105129 | A1 * | 8/2002 | Levy | B25H 1/04 269/45 |
| 2005/0051940 | A1 * | 3/2005 | Bensman | 269/139 |
| 2008/0142301 | A1 * | 6/2008 | Meyers | E06C 1/387 182/180.1 |

FOREIGN PATENT DOCUMENTS

| | | | |
|---|---|---|---|
| EP | 2090740 | A1 | 8/2009 |
| EP | 2103397 | A1 | 9/2009 |
| FR | 2895692 | A1 | 7/2007 |

OTHER PUBLICATIONS

International Search Report for PCT/NL2010/050740 dated Mar. 8, 2011.

* cited by examiner

COMBINED PORTABLE STEP STOOL AND WORKPIECE SUPPORT DEVICE

CROSS-REFERENCE TO RELATED APPLICATIONS

This application is a continuation of U.S. Application Ser. No. 13/504,631, filed Jul. 11, 2012, which is the National Stage of International Application No. PCT/NL2010/050740, filed Nov. 5, 2010, which claims the benefit of Netherlands Application No. 2003764, filed Nov. 6, 2009, the contents of all of which are incorporated by reference herein.

FIELD OF THE INVENTION

The present invention relates to a combined portable step stool and workpiece support device.

BACKGROUND OF THE INVENTION

Craftsmen, e.g. carpenters, plumbers, etc, are frequently in need of a step stool as well as a suitable workpiece support device. For instance carpenters make use of a sawhorse.

U.S. Pat. No. 5,265,697 discloses a sawhorse that is easily assembled and disassembled. The sawhorse has four legs, a top rail and a shelf. The shelf is designed to function as a step, so that a person can stand on the shelf, e.g. to reach an eight foot ceiling. This sawhorse is of limited versatility both with regard to its climbing function as to its workpiece support function.

OBJECT OF THE INVENTION

It is an object of the present invention to provide a combined portable step stool and workpiece support device.

It is a further object of the present invention to provide a combined portable step stool and workpiece support device that is easy and practical to use and compact for transportation and storage.

SUMMARY OF THE INVENTION

The present invention achieves one or more of the above objects by providing a combined portable step stool and workpiece support device comprising: a folding frame having: a rigid front leg structure including a pair of spaced apart front legs, each front leg having a foot, and including a first support bar interconnecting the front legs at an upper end thereof, a rear leg structure including a pair of spaced apart rear legs, each rear leg having a foot, the rear leg structure being pivotally coupled to the front leg structure via one or more first hinges for pivotable movement of the rear leg structure between an opened use position and a collapsed storage position, wherein the portions of the front legs above the first hinges and the first support bar interconnecting said portions at an upper end thereof form a first workpiece support bracket of the device, wherein the folding frame furthermore comprises an upper step and one or more lower steps, the steps being movably arranged for movement between a horizontal use position and a storage position, each step being adapted to support a person thereon, and wherein the device furthermore comprises a pivotable rigid second workpiece support bracket, said second workpiece support bracket comprising a pair of spaced apart arms, each arm having a lower end pivotally connected via a second hinge to the folding frame, the second workpiece support bracket furthermore comprising a second support bar interconnecting said arms at an upper end thereof, and wherein the rigid second workpiece support bracket is pivotal about said second hinges between a use position, wherein the first and second workpiece support brackets are in diverging, preferably in a V-shaped, arrangement when seen in side view of the device, and a collapsed position, wherein the first and second workpiece support brackets are generally parallel to each other, and wherein in the use position of the second workpiece support bracket the first and second support brackets together define workpiece support faces in a, preferably horizontal, support plane, e.g. allowing to support a planar workpiece.

Preferably each rear leg is pivotally coupled to a front leg via a first hinge that is arranged intermediate the foot and the upper end of the front leg for pivotal movement of the rear leg structure between the opened use position and the collapsed storage position.

Preferably the first hinges and the second hinges are integrated in a common hinge assembly having a common hinge axis.

Preferably the height of the support bars of the support brackets when the device is used as workpiece support is between 0.5 and 1.2 meter, more preferably between 0.7 and 1.0 meter.

Preferably a locking device is provided for locking the second workpiece support bracket in at least one of its use position and its collapsed storage position. In a possible embodiment the second bracket is provided with a user operable locking device, e.g. including a movable hook member, engaging on a corresponding part, e.g. an opening, of the first bracket to lock the second bracket in its storage position.

Preferably a locking device is provided for locking the second workpiece support bracket at least in its use position.

In a possible embodiment the locking device for the second workpiece support bracket may be integrated with one or each of the second hinges. For example a locking device having one or mobile locking pins which can be made to engage in one or more associated holes, e.g. as disclosed in EP1182322 or U.S. Pat. No. 4,566,150, can be employed.

Preferably a locking device is provided for locking the rear leg structure at least in its use position, preferably the locking device being integrated with each of the first hinges. Locking of the rear leg structure may also be done via an embodiment of one or more of the steps, so that said one or more steps provide the locking effect. A step may be provided with a dedicated locking device to secure the step in its use position, and thereby also secure the rear leg structure in its use position. A step with locking device is e.g. known from EP 2090740.

Preferably one or more steps are composed of a front step part and a rear step part, the front step part being pivotally connected to the front leg structure and the rear step part being pivotally connected to the rear leg structure, the front and rear step parts also being pivotally connected to each other so as to allow each step to assume a folded state when the folding frame is collapsed.

In a preferred embodiment the device has an upper step and a lower step, the upper step being pivotable and the lower step being foldable, and wherein a connecting assembly extends between the upper step and the lower step, preferably in the plane of the pivotal connection between the front and the rear step parts thereof, such that lifting a part of the upper step to cause pivoting thereof—and thereby collapse of the folding frame—results in folding of the lower step.

In a possible embodiment the upper step is pivotable or foldable and is provided with a hand grip allowing a user to grip the upper step or part thereof and to pivot the upper step or part thereof, so as to cause the motion of the rear leg structure from the use position to the storage position.

In a possible embodiment the first and second workpiece support brackets each have at their upper side at least one recessed portion, preferably a V-shaped recessed portion, the recessed portions in both support brackets being aligned with one another allowing to receive a workpiece in the aligned recessed portions of both support brackets.

As is preferred, possibly in combination with said recessed portion or portions, the support bars each include a central rectilinear portion.

In a practical embodiment of the first and second support brackets, a recessed portion is present at each end of a central portion of the support bar, the central portion preferably being rectilinear.

In an embodiment the support brackets have support bar extension portions at each of the support bars and aligned with the support bars. Preferably these extension portions have parallel top and bottom surfaces to facilitate clamping of the workpiece thereon with a clamping device.

In a possible embodiment each support bar is provided with a longitudinal groove extending over the length of the support bar at the top side thereof, e.g. allowing to place an object in the shape of a rod or a tube therein.

In a possible embodiment the legs of the front leg structure and/or of the rear leg structure are rigidly interconnected by a horizontal cross member of said respective structure at the height of a step.

In a possible embodiment the feet of the front leg and the rear leg at each side of the device and the side ends of the workpiece support brackets at said side of the device are in a common plane so as to allow to place the device with said side on a floor and use the feet and side ends of the workpiece support brackets at the other side of the device as support faces for a workpiece.

Further preferred embodiments of the device are disclosed in the subclaims and the following description.

BRIEF DESCRIPTION OF THE DRAWINGS

The invention will be illustrated in more detail with reference to the appended drawings. In the drawings.

Figure 1:
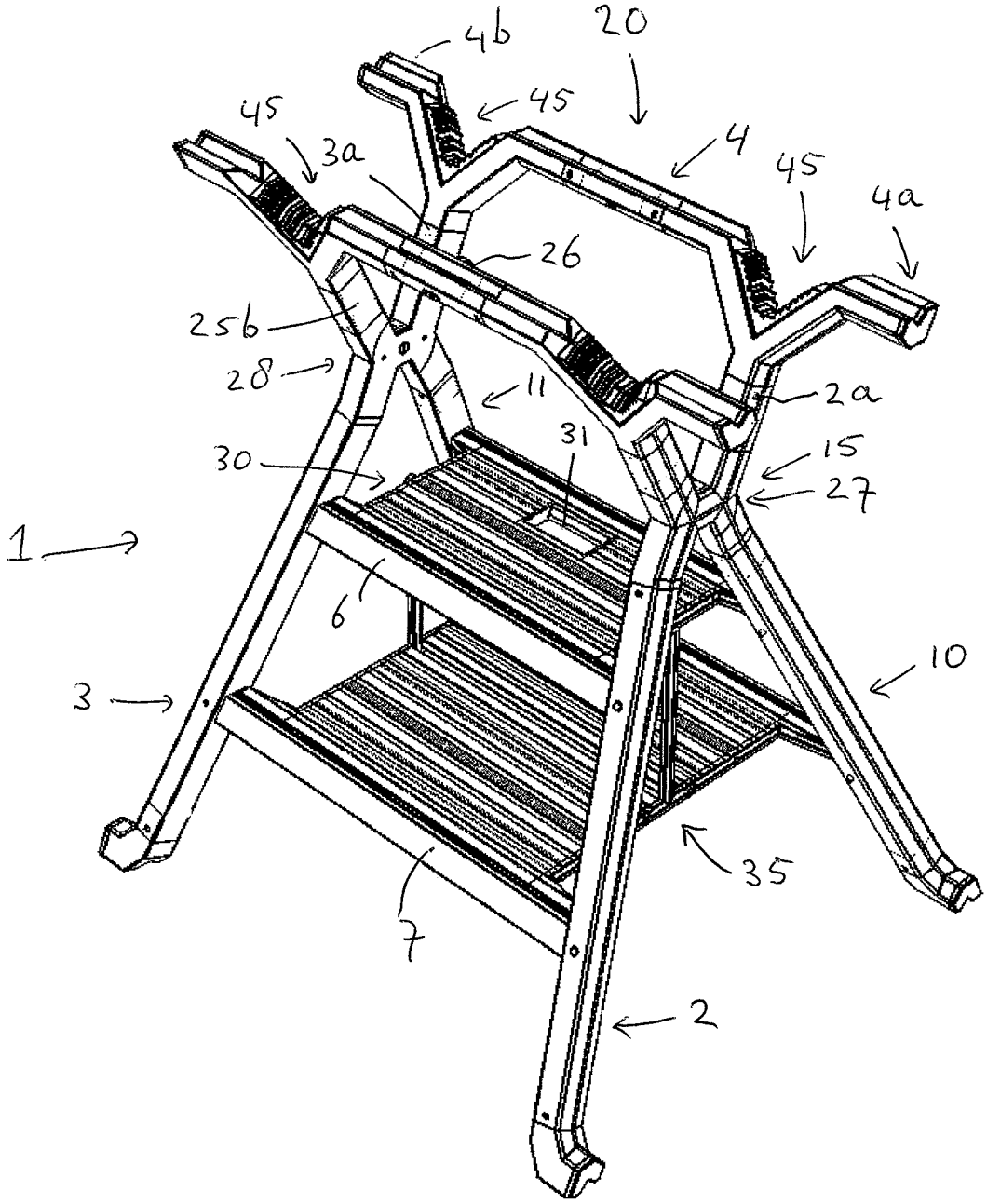
FIG. 1 shows a preferred embodiment of a device according to the invention with the second workpiece support bracket in use position.

DETAILED DESCRIPTION OF PREFERRED EMBODIMENTS:

In the drawings a preferred embodiment of a combined step stool and workpiece support device 1 is shown. It is envisaged that the device 1 is appreciated by professional craftsmen, e.g. carpenters, plumbers, electricians, etc. Clearly DIY-use or any other use is also possible. The device 1 is portable.

In general the device comprises a folding frame having a rigid front leg structure and a rear leg structure as well as steps. An upper section of the rigid front leg structure forms a first workpiece support bracket of the device. The device also includes a pivotable second workpiece support bracket, that is arranged pivotal on the folding frame. In its use position the second support bracket together with the first support bracket define multiple workpiece support faces in a common horizontal support plane, e.g. allowing to support a planar workpiece, e.g. a wooden sheet material workpiece, on the device. In its collapsed position the second support bracket is generally parallel to the first support bracket, e.g. lying against it, and a person can step onto the steps of the device and stand on the upper step. The support brackets then form a safety means for the person standing on the upper step. A person can also sit on the upper step in this collapsed position of the second support bracket. Preferably the device 1 meets the requirements of European Standard EN 14183 for step stools.

The rigid front leg structure includes a pair of spaced apart front legs 2, 3, each front leg having a foot, here with an end cap. The rigid front leg structure also includes a first support bar 4 interconnecting the front legs 2, 3 at an upper end thereof. So in general the rigid front leg structure has the shape of an inverted U.

The folding frame also has a rear leg structure which includes a pair of spaced apart rear legs 10, 11, each rear leg having a foot, here with an end cap. Each rear leg 10, 11 is pivotally coupled to a respective front leg 2, 3 via a first hinge 15, 16. The first hinges 15, 16 are each arranged at a location intermediate the foot and the upper end of the respective front leg 2, 3. This hinged connection allows for pivotal movement of the rear leg structure between an opened use position (see drawings) and a collapsed storage position (not shown), as is preferred generally parallel to the lower portions of the front legs 2, 3. In the opened use position the lower portion of a front leg and the rear leg are positioned in the shape of an inverted V when seen in side view of the device.

As is preferred the front leg structure and the rear leg structure are made of metal profiles, here aluminium profiles, in this example tubular profiles.

The upper portions 2*a*, 3*a* of the front legs 2, 3 above the first hinges 15, 16 in combination with the first support bar 4 interconnecting said portions 2*a*, 3*a* at an upper end thereof form a first workpiece support bracket of the device 1, here generally indicated with reference numeral 20.

The folding frame further has an upper step 30 and one or more lower steps. As is preferred a single lower step 35 is present in the device 1. In another somewhat taller device 1, two lower steps are preferred.

The upper step 30 is preferably dimensioned such that a person can stand on it with his two feet next to one another.

As is preferred the upper step 30 is arranged at a distance below the first and second hinges.

The steps 30, 35 are movably arranged on the folding frame of the device for movement between a horizontal use position (see drawings) and a storage position (not shown here).

Each step 30, 35 is adapted to support a person thereon, e.g. designed to withstand a vertical test load of 150 kilograms.

In the storage position each step is preferably received within the space between the legs of the device for minimal storage space requirements.

The device has a pivotable rigid second workpiece support bracket 25. This second workpiece support bracket comprises a pair of spaced apart arms 25*a*, 25*b*, each arm 25*a*, 25*b* having a lower end pivotally connected via a second hinge 27, 28 to the folding frame. The second workpiece support bracket 25 has a second support bar 26 rigidly interconnecting said arms 25*a*, 25*b* at an upper end thereof. So in general the support bracket 25 is a rigid element and has a shape resembling an inverted U.

As is preferred the second support bracket 25 is made of metal profiles, here aluminium profiles, in this example tubular profiles.

Figure 2:
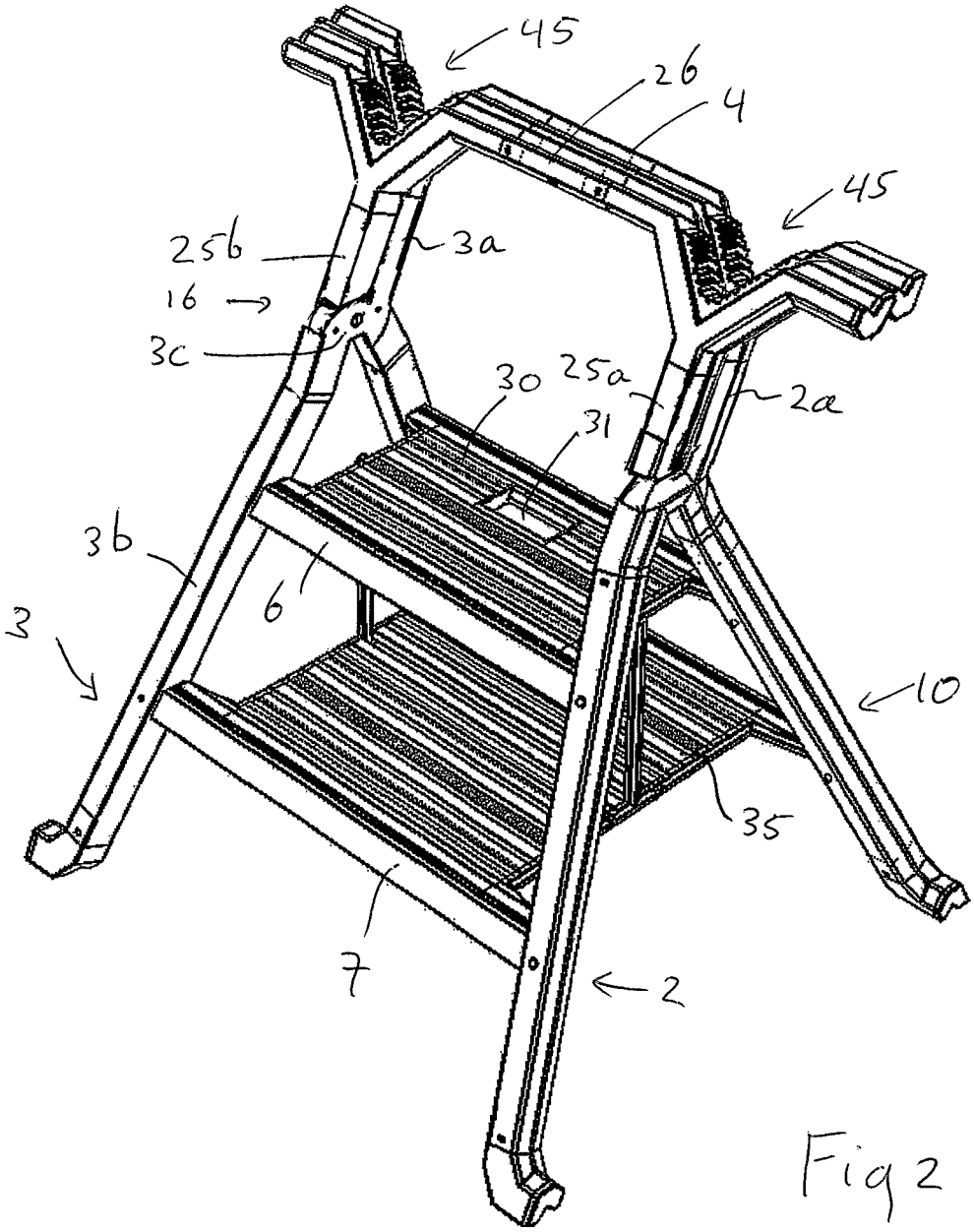
FIG. 2 shows the device of FIG. 1 with the second workpiece support bracket in collapsed storage position.
Figure 3:
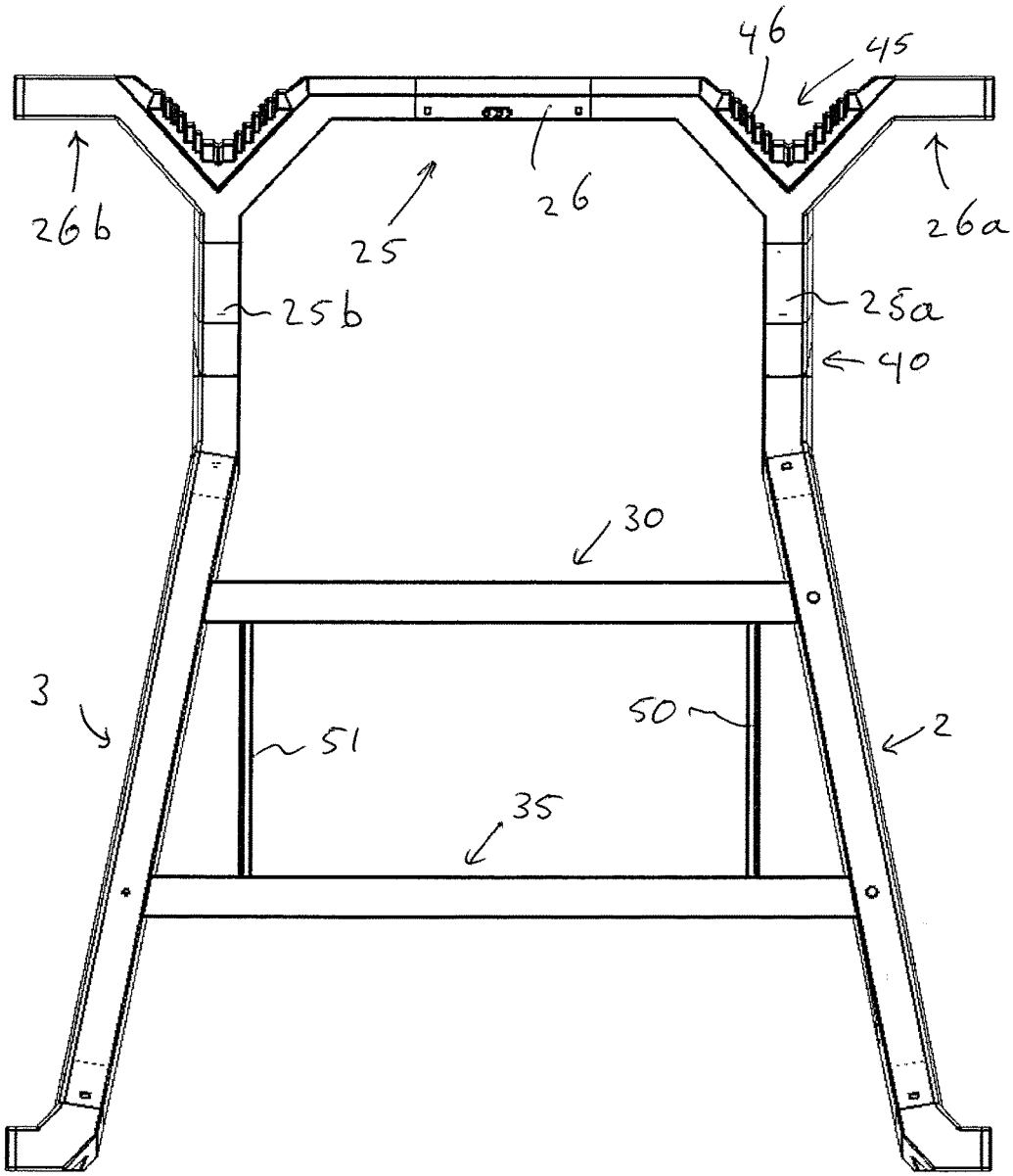
FIG. 3 shows the device of FIG. 1 in front view.

The rigid second workpiece support bracket 25 is pivotal about the second hinges 27, 28 between a use position (see FIGS. 1, 3, 4, 5, and 6) and a collapsed position (see FIG. 2).

In the use position of the second support bracket 25, the first and second support brackets 20, 25 are in a divergent arrangement when seen in side view of the device, their lower ends being closer to one another than their upper ends. Preferably the divergent arrangement is a generally V-shaped arrangement when seen in side view of the device (see drawings).

In the collapsed position of the second support bracket (see FIG. 2), the first and second support brackets 20, 25 are generally parallel to each other, preferably close to one another, in this example—as is preferred—the second bracket 25 lying against the front side of the first support bracket 20.

As is preferred, the support brackets 20, 25 are of similar shape and dimensions, so that in the collapsed position of the second bracket 25 the arms 25*a*, 25*b* thereof extend along the front side of the upper leg portions 2*a*, 3*a* of the front legs 2,3 and the support bar 26 extends along the front side of the support bar 4 (see FIG. 2).

In the use position of the second support bracket 25 the first and second support brackets 20, 25 together define multiple workpiece support faces in a common horizontal plane (assuming the feet are resting on a horizontal floor), e.g. allowing to support a planar workpiece, e.g. a wooden sheet material workpiece, on the top side of the support brackets 20, 25.

As is preferred the arms 25*a*, 25*b* of the second support bracket 25 are of approximately the same length as the upper front leg portions of the first support bracket 20. In the side view this results in the arms of the V-shape formed by the brackets 20, 25 having the same length.

Figure 5:
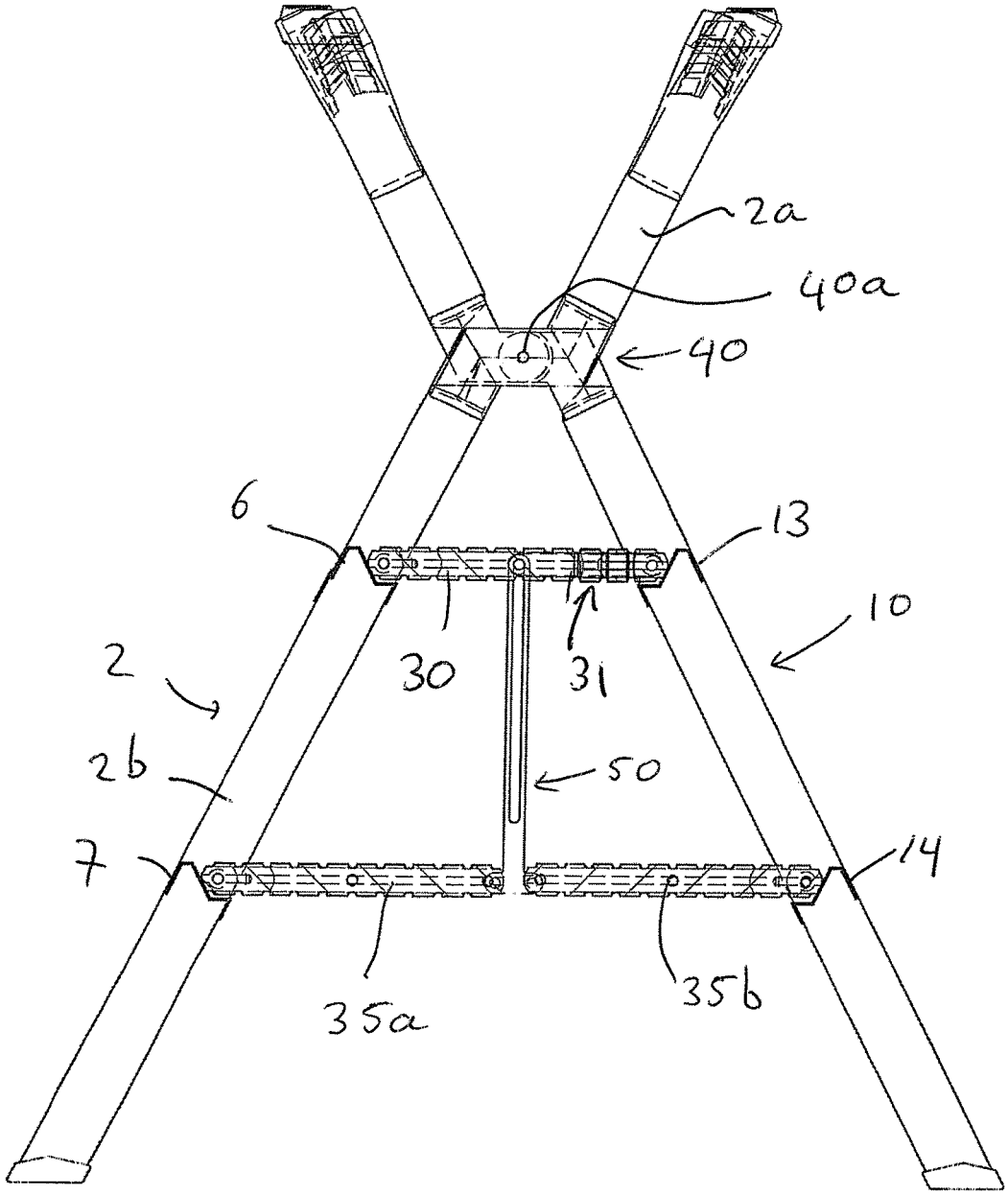
FIG. 5 shows the device of FIG. 1 in side view.

As is highly preferred the first hinge and the second hinge at each side of the device 1 are integrated into a common hinge assembly 40 having a common horizontal hinge axis 40*a*, indicated with reference numerals in FIG. 5.

Figure 4:
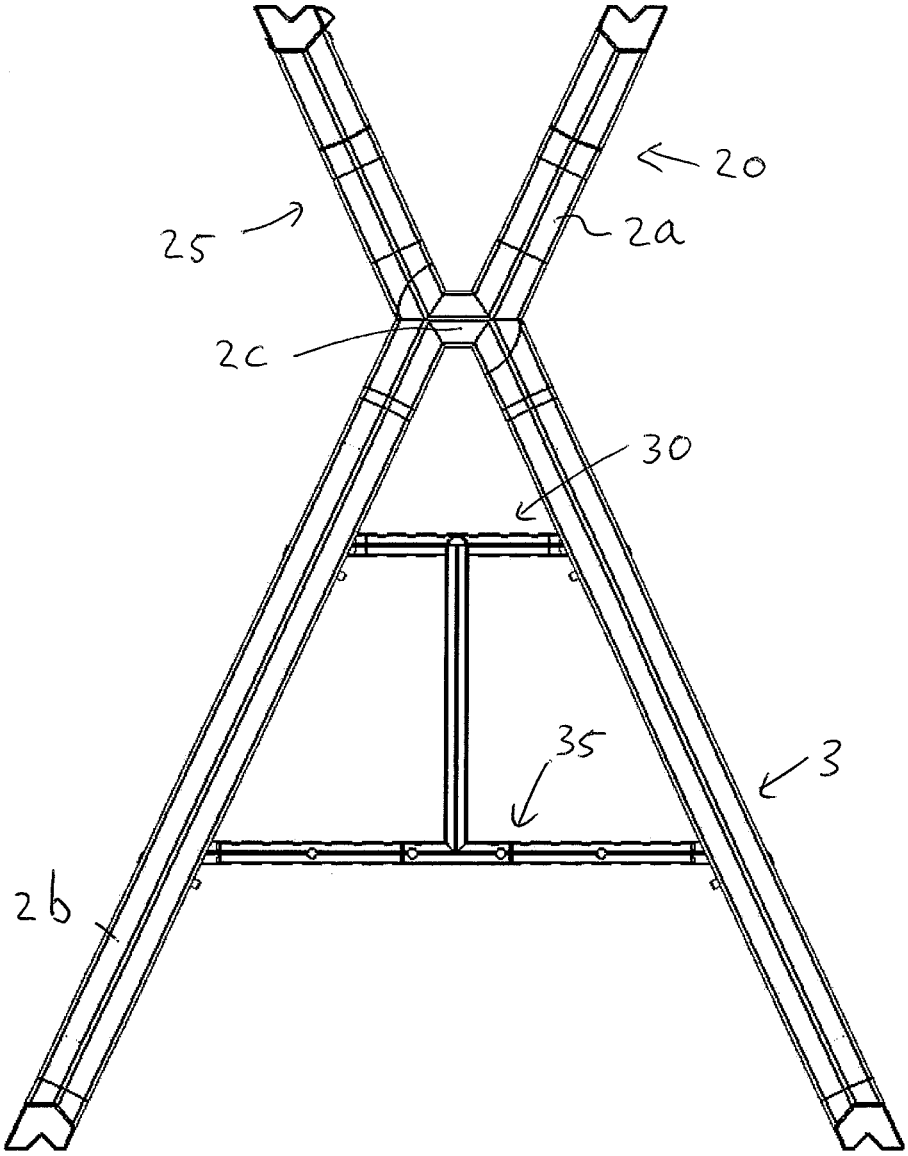
FIG. 4 shows the device of FIG. 1 in side view.

As is preferred the front legs 2, 3 each have a lower portion 2*b*, 3*b* and an upper portion 2*a*, 3*a* that is parallel to and offset from the lower portion (when seen in side view as in FIGS. 4, 5). A bridge portion 2*c*, 3*c* of the front leg 2, 3 is present between said lower and upper portion of a front leg.

As is preferred the first hinge and/or second hinge are connected to the bridge portion 2*c*, 3*c* of the front legs 2,3. In this embodiment the combined hinge assembly 40 is mounted to said bridge portion 2*c*, 3*c*.

It will be appreciated that the second hinges of the second support bracket 25 could also be arranged elsewhere on the folding frame, e.g. on an upper portion of the rear leg structure, this is however not preferred.

As is preferred a second support bracket locking device (not shown) is provided for locking the second support bracket 25 at least in its use position, preferably also in its collapsed position. The locking device is preferably integrated with each of the second hinges, or with the hinge assembly 40 when present. Preferably the locking device is adapted to lock automatically when the support bracket 25 reaches a predetermined locking position, such as corresponding to the use position, and preferably user operable actuation means are provided to unlock the locking device when it is desired to move the second support bracket 25.

As is preferred a locking device is provided for locking the rear leg structure at least in its use position. Preferably the locking device is adapted to lock automatically when the rear leg structure reaches a predetermined locking position, such as corresponding to the use position. Preferably this rear leg structure locking device is integrated with each of the first hinges or with the hinge assembly 40 when present.

In this embodiment the step 30 is a pivotable step, having a pivot axis at or near the front side of the step. A latching arrangement for the step is provided (not shown) for latching the step in the horizontal use position. Preferably the latching arrangement also allows a latching in storage position of the step, thereby latching the rear leg structure in its collapsed storage position. Preferably the latching arrangement includes a user operable actuator that allows to release an automatic latching mechanism, the user operable actuator preferably being arranged at or embodied as a hand grip 31.

The lower step 35 is a folding step and is composed of a front step part 35*a* and a rear step part 35*b*. The front step part 35*a* is pivotally connected to the front leg structure and the rear step part 35*b* is pivotally connected to the rear leg structure.

The front and rear step parts of step 35 are also pivotally connected to each other so as to allow the step 35 to assume a folded state when the folding frame is collapsed.

As can be seen a connecting assembly extends between the upper step 30 and the lower step 35, here, as is preferred, in the plane of the pivotal connection between the front and the rear step parts thereof. The connection assembly is adapted such that lifting a part of the upper step by the user to cause pivoting of the upper step or part thereof—and thereby collapse of the folding frame—results in folding of the lower step 35.

In this example the connecting assembly includes two spaced apart connectors 50, 51. The connectors 50, 51 each have a lower end connected to a pivot shaft between the front and rear step parts of the lower step 35 and each have a pin-and-slot connection with the upper step 30. The pin-and-slot connection may be replaced by any other telescoping embodiment of the connectors 50, 51 or even by a flexible connector, e.g. a cable.

In this embodiment the upper step is foldable and is provided with a hand grip 31 allowing a user to grip the upper step and to pivot the step, so as to cause the motion of the rear leg structure from the use position to the storage position.

It will be appreciated that it is preferred that the upper step 30 spans the entire distance between the front leg structure and the rear leg structure to obtain an optimal size of the upper step. The lower step could be of a reduced depth compared to the embodiment shown here —when seen from the front thereof—e.g. not reaching the rear leg structure. As it is envisaged that the lower step 35 can also be used as a platform for storage of e.g. a tool box, it is however preferred that the lower step 35 also spans the entire distance between the front leg structure and the rear leg structure.

It will be appreciated that the design of the steps, the mobile arrangement of the steps in the frame, and the linkage between the steps to cause motion of all steps upon folding the frame may vary from the depicted embodiment. Alternatives for these features are well known in the field of folding step stools.

As is preferred the height of the support bars 4, 26 of the support brackets 20, 25 above the floor when the device is used as workpiece support (see FIG. 1) is between 0.5 and 1.2 meter, preferably between 0.7 and 1.0 meter.

As is preferred the height of the first support bar above the upper step is at least 0.30 meter, preferably between 0.35 and 0.50 meter.

As is preferred the first and second workpiece support brackets 20, 25 each have at their upper side at least one recessed portion 45, as is preferred a V-shaped recessed portion, for receiving a workpiece therein. The recessed portions in the brackets 20, 25 are aligned with one another allowing to receive a workpiece in the aligned recessed portions of the brackets 20,25.

Preferably the side faces of the recessed portions 45 have a ribbed design, providing extra grip for a workpiece. The ribs may be designed to correspond to standard size workpieces, e.g. standard size timber elements. Preferably a plastic element 46 is provided with these ribs and fitted into the recessed portions.

As is preferred the support bars 4, 26 each include a central rectilinear portion, and a recessed portion 45 is present at each end of a central portion of the support bar.

Also, as is preferred, the support brackets 20, 25 each have support bar extension portions 4*a*, 4*b*, 26*a*, 26*b* for each of the support bars and aligned with the central portion of the support bars.

As is preferred the extension portions, and/or possibly other portions of the support brackets, have parallel top and bottom surfaces to facilitate the clamping of the workpiece thereon with a clamping device.

As can be seen the front legs 2, 3 are rigidly interconnected by a horizontal cross member 6, 7 at the height of each step 30, 35, which is preferred for strength and stability of the device.

As can be seen the rear legs 10, 11 are rigidly interconnected by a horizontal cross member 13, 14 at the height of each step 30, 35, which is preferred for strength and stability of the device.

Figure 6:
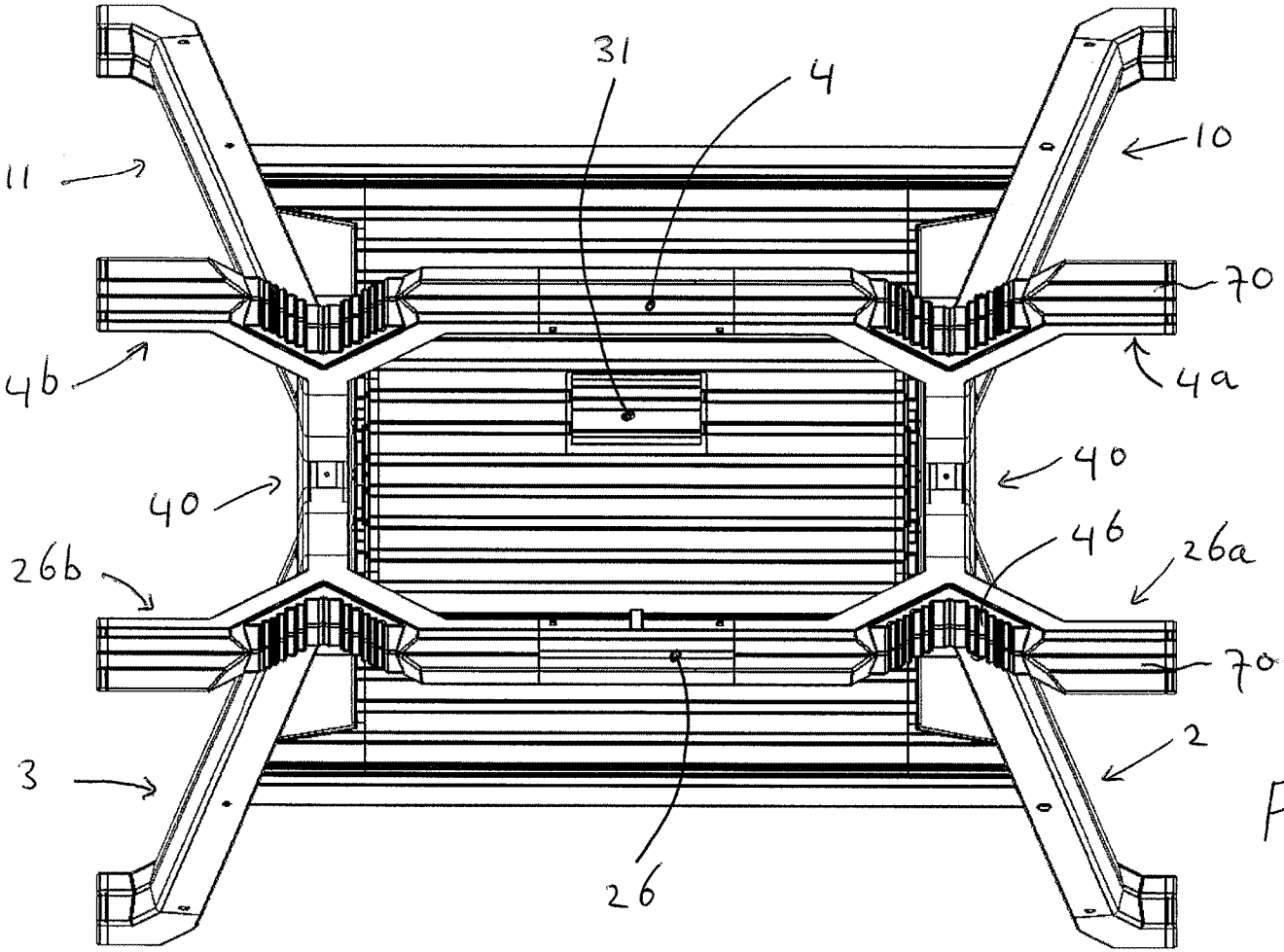
FIG. 6 shows the device of FIG. 1 from above.

As is preferred, and as can be seen at best in FIG. 6, the feet of the front leg and the rear leg at each side of the device and the side ends of the workpiece support brackets at said side of the device are in a common plane so as to allow to place the device 1 with a side thereof on a floor and use the feet and side ends of the workpiece support brackets at the other side of the device as support faces for a workpiece, e.g. a planar workpiece.

Figure 7:
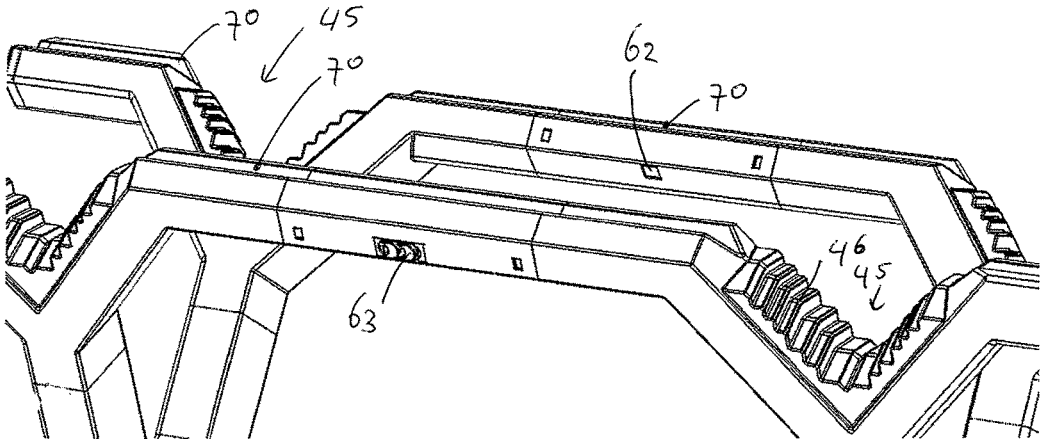
FIG. 7 shows the workpiece support brackets of the device.
Figure 8:
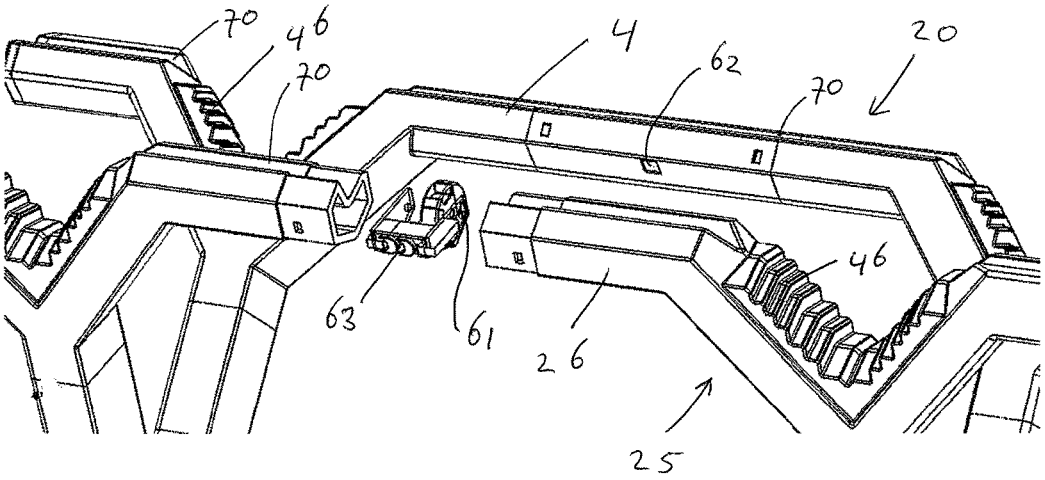
FIG. 8 shows the brackets of FIG. 7 with the locking device exposed.

With reference to FIGS. 7 and 8 further optional details of the workpiece support brackets of the device will be discussed.

In FIGS. 7 and 8 a locking device 60 is shown for locking the second bracket 25 in its storage position. The locking device 60 is integrated in the second bracket 25, as is preferred in the support bar 26, and engages on the first bracket 20.

The locking device 60 here includes a mobile hook member 61, here a rotatable hook member that is housed in the support bar 26, that hooks into an opening 62 on the bracket 20. The hook member 61 here is connected to a button 63 that can be operated by the user.

In FIGS. 7 and 8 it can be seen that the support bars 4, 26, or at least one or them, is provided with a longitudinal groove 70 at its top side, allowing to place a rod or tube shaped workpiece in the groove, e.g. when sawing to length a tube.

The invention claimed is:

1. A combined portable step stool and workpiece support device, said device comprising:

a folding frame having:

a rigid front leg structure including a pair of spaced apart rigid front legs, each front leg having a lower portion and an upper portion, wherein said upper front leg portion is parallel to and offset from the lower portion and wherein a bridge portion is present between said lower and upper front leg portion, each front leg furthermore having a foot, and said rigid front leg structure including a first support bar interconnecting the front legs at an upper end thereof, said front legs and said first support bar each having a front side, and a rigid rear leg structure including a pair of spaced apart rigid rear legs, each rear leg having a foot, the rear leg structure being pivotally coupled to the front leg structure via first hinges for pivotable movement of the rear leg structure between an opened use position and a collapsed storage position, wherein said first hinges are connected to the bridge portions of the front leg structure, wherein the upper front leg portions and the first support bar form a first workpiece support bracket of the device, wherein the folding frame furthermore comprises steps consisting of an upper step and one lower step, said steps each being movably arranged for movement between a horizontal use position and a storage position, wherein said upper step is arranged at a distance below said bridge portions and wherein each step is adapted to support a person thereon, wherein the device furthermore comprises a pivotable rigid second workpiece support bracket, said second workpiece support bracket comprising a pair of spaced apart arms, each arm having a lower end pivotally connected via a second hinge to the bridge portion of a respective front leg, wherein each second hinge is integrated with the first hinges that is connected to the bridge portion of the respective front leg in a common hinge assembly having a common hinge axis, the second workpiece support bracket furthermore comprising a second support bar interconnecting said arms of the second workpiece support bracket at an upper end thereof, wherein, with the rear leg structure remaining in the opened use position, the rigid second workpiece support bracket is pivotal about said second hinges between a collapsed position, wherein the arms of the second workpiece support bracket lies in front of the upper front leg portions of the front legs and wherein the second support bar lies in front of the first support bar, and a use position, wherein the second workpiece support bracket is pivoted in a forward direction away from the front side of the first workpiece support bracket, wherein the first and second workpiece support brackets are in diverging arrangement when seen in side view of the device and wherein said device is open at the top, wherein in the use position of the second workpiece support bracket the first and second support brackets together define workpiece support faces in a horizontal support plane allowing to support a planar workpiece thereon, wherein in the use position of the second workpiece support bracket the open topped device allows to introduce from above a workpiece in between the first and second workpiece support brackets, wherein the front leg structure comprises a horizontal cross member between said front legs and wherein the rear leg structure comprises a horizontal cross member between said rear legs, and wherein the upper step is a pivotable step having a pivot axis near said horizontal cross member between said front legs, and wherein said upper step has a depth such that in said horizontal use position thereof and with the rear leg structure in opened use position thereof the upper step spans the distance between said horizontal cross members, wherein the lower step is composed of a front step part and a rear step part, the front step part being pivotally connected to the front leg structure and the rear step part being pivotally connected to the rear leg structure, the front and rear step parts also being pivotally connected to each other so as to allow said lower step to assume a folded state when the folding frame is collapsed, wherein a connecting assembly extends between the upper step and the lower step, such that pivoting the upper step away from said horizontal use position causes folding of the lower step resulting in collapsing of the folding frame; and wherein the feet of the front leg and the rear leg at each side of the device and side ends of the workpiece support brackets at said side of the device are in a common plane so as to allow to place the device with said side on a floor and use the feet and side ends of the workpiece support brackets at the other side of the device as support faces in a horizontal support plane for a workpiece.

2. The device according to claim 1, wherein a locking device is provided for locking the second workpiece support bracket in its collapsed storage position.

3. The device according to claim 2, wherein the locking device is a user operable locking device provided onto the second workpiece support bracket and engaging on the first workpiece support bracket to lock the second workpiece support bracket in the storage position.

4. The device according to claim 2, wherein the locking device comprises a mobile hook member housed in the second support bar that hooks into an opening on the first workpiece support bracket, said mobile hook member being connected to a button operated by the user.

5. The device according to claim 1, wherein the upper step is provided with a hand grip allowing a user to grip the upper step.

6. The device according to claim 1, wherein the arms and the second support bar of the second workpiece support bracket are metal profiles.

7. The device according to claim 1, wherein the support bars of the support brackets each include a central rectilinear portion.

8. A combined portable step stool and workpiece support device, said device comprising:

a folding frame having:

a rigid front leg structure including a pair of spaced apart rigid front legs, each front leg having a lower portion and an upper portion, wherein said upper front leg portion is parallel to and offset from the lower portion and wherein a bridge portion is present between said lower and upper front leg portion, each front leg furthermore having a foot laterally extending past the front leg, and said rigid front leg structure including a first support bar interconnecting the front legs at an upper end thereof, said front legs and said first support bar each having a front side, and a rigid rear leg structure including a pair of spaced apart rigid rear legs, each rear leg having a foot laterally extending past the rear leg, the rear leg structure being pivotally coupled to the front leg structure via first hinges for pivotable movement of the rear leg structure between an opened use position and a collapsed storage position, wherein said first hinges are connected to the bridge portions of the front leg structure, wherein the upper front leg portions and the first support bar form a first workpiece support bracket of the device, wherein the folding frame furthermore comprises steps consisting of an upper step and one lower step, said steps each being movably arranged for movement between a horizontal use position and a storage position, wherein said upper step is arranged at a distance below said bridge portions and wherein each step is adapted to support a person thereon, wherein the device furthermore comprises a pivotable rigid second workpiece support bracket, said second workpiece support bracket comprising a pair of spaced apart arms, each arm having a lower end pivotally connected via a second hinge to the bridge portion of a respective front leg, wherein each second hinge is integrated with the first hinges that is connected to the bridge portion of the respective front leg in a common hinge assembly having a common hinge axis, the second workpiece support bracket furthermore comprising a second support bar interconnecting said arms of the second workpiece support bracket at an upper end thereof, wherein, with the rear leg structure remaining in the opened use position, the rigid second workpiece support bracket is pivotal about said second hinges between a collapsed position, wherein the arms of the second workpiece support bracket lies in front of the upper front leg portions of the front legs and wherein the second support bar lies in front of the first support bar, and a use position, wherein the second workpiece support bracket is pivoted in a forward direction away from the front side of the first workpiece support bracket, wherein the first and second workpiece support brackets are in diverging arrangement when seen in side view of the device and wherein said device is open at the top, wherein in the use position of the second workpiece support bracket the first and second support brackets together define workpiece support faces in a horizontal support plane allowing to support a planar workpiece thereon, wherein in the use position of the second workpiece support bracket the open topped device allows to introduce from above a workpiece in between the first and second workpiece support brackets, wherein the front leg structure comprises a horizontal cross member between said front legs and wherein the rear leg structure comprises a horizontal cross member between said rear legs, and wherein the upper step is a pivotable step having a pivot axis near said horizontal cross member between said front legs, and wherein said upper step has a depth such that in said horizontal use position thereof and with the rear leg structure in opened use position thereof the upper step spans the distance between said horizontal cross members, wherein the lower step is composed of a front step part and a rear step part, the front step part being pivotally connected to the front leg structure and the rear step part being pivotally connected to the rear leg structure, the front and rear step parts also being pivotally connected to each other so as to allow said lower step to assume a folded state when the folding frame is collapsed, wherein a connecting assembly extends between the upper step and the lower step, such that pivoting the upper step away from said horizontal use position causes folding of the lower step resulting in collapsing of the folding frame;

wherein side ends of the workpiece support brackets have extension portions to laterally extend the work piece brackets past the rear and front legs; and wherein the feet of the front leg and the rear leg at each side of the device and side ends of the workpiece support brackets at said side of the device are in a common plane so as to allow to place the device with said side on a floor and use the feet and side ends of the workpiece support brackets at the other side of the device as support faces in a horizontal support plane for a workpiece.

* * * * *